US007287384B2

(12) United States Patent
Fish et al.

(10) Patent No.: US 7,287,384 B2
(45) Date of Patent: Oct. 30, 2007

(54) BEARING CHAMBER PRESSURIZATION SYSTEM

(75) Inventors: Jason Araan Fish, Brampton (CA); Pierre-Yves Légaré, Chambly (CA); Eduardo David Hawie, Woodbridge (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 373 days.

(21) Appl. No.: 11/009,041

(22) Filed: Dec. 13, 2004

(65) Prior Publication Data

US 2006/0123795 A1 Jun. 15, 2006

(51) Int. Cl.
*F02C 7/06* (2006.01)
*F02C 7/08* (2006.01)
*F02C 7/18* (2006.01)

(52) U.S. Cl. ..... 60/782; 60/785; 60/39.08; 60/39.83; 415/111

(58) Field of Classification Search ..... 60/39.08, 60/39.83, 782–785, 799; 415/110–113, 115; 184/6.11
See application file for complete search history.

(56) References Cited

U.S. PATENT DOCUMENTS 3,133,693 A * 5/1964 Holl ..... 184/6.11
3,263,424 A * 8/1966 Birmann ..... 60/799
4,497,172 A 2/1985 Smith
4,542,623 A 9/1985 Hovan et al.
4,561,246 A 12/1985 Hovan
4,574,584 A 3/1986 Hovan
4,709,545 A 12/1987 Stevens et al.
4,761,947 A * 8/1988 Hennecke et al. ..... 60/39.83
5,482,431 A 1/1996 Taylor
5,555,721 A * 9/1996 Bourneuf et al. ..... 60/806
5,622,438 A 4/1997 Walsh et al.
5,862,666 A * 1/1999 Liu ..... 60/726
6,227,801 B1 5/2001 Liu
6,361,277 B1 * 3/2002 Bulman et al. ..... 416/96 R
6,513,335 B2 * 2/2003 Fukutani ..... 60/785
6,516,618 B1 2/2003 Bock
6,647,730 B2 11/2003 Liu
6,655,153 B2 12/2003 Akiyama et al.
6,679,045 B2 1/2004 Karafillis et al.

* cited by examiner

*Primary Examiner*—Ted Kim
(74) *Attorney, Agent, or Firm*—Ogilvy Renault LLP

(57) ABSTRACT

A method and device for improved pressure balancing in a bearing chamber pressurization system for gas turbine engines employ a partition member to substantially separate first and second air-oil seals of the bearing housing.

16 Claims, 3 Drawing Sheets

BEARING CHAMBER PRESSURIZATION SYSTEM

FIELD OF THE INVENTION

The present invention relates to gas turbine engines, and more particularly to a bearing chamber pressurization system for gas turbine engines.

BACKGROUND OF THE INVENTION

Bearing chamber pressurization is often provided in gas turbine engines in order to improve the air-oil sealing provided by the seals for the bearing chamber, and thereby enhance the ability to prevent oil from leaking from the bearing chamber. Some leakage may occur in some instances, and in these instances, it is preferable to direct the leakage in a manner which has the minimum adverse impact on the engine and its operation. In bearings located adjacent the compressor, for example, it is desirable to minimize the oil which leaks into bleed air systems, to thereby minimize the possibility of aircraft cabin bleed air contamination with oil. Various pressurization systems are known, but improvements to the weight, cost and size thereof are always desired, and it is an object of the present invention to provide an improved pressurization system.

SUMMARY OF THE INVENTION

One object of the present invention is to provide improved pressure balancing in a bearing chamber pressurization system of a gas turbine engine.

In accordance with one aspect of the present invention, there is a bearing chamber pressurization system provided for a gas turbine engine, which comprises a bearing housing defining a bearing chamber therein, the housing having first and second air-oil seals. A source of pressurized air is provided, communicating with the air-oil seals along an air flow path. A partition is disposed within the air flow path between the first and second air-oil seals of the bearing housing. The system further includes at least one metering orifice in the air flow path upstream of the second air-oil seal, forming a passage by-passing the first air-oil seal. The orifice is disposed in the partition and adapted to regulate relative pressures of the pressurized air provided to the first and second air-oil seals.

In accordance with another aspect of the present invention, there is a bearing chamber pressurization system provided for a gas turbine engine, which comprises a bearing housing defining a bearing chamber therein, the housing having first and second air-oil seals. A source of pressurized air is provided, communicating with the air-oil seals along an air flow path. Means are provided for regulating a pressure of the pressurized air. Said means are provided at least partially by a centrifugal compressor heat shield of the engine and adapted to provide a pre-determined pressure difference in the pressurized air provided to the first and second air-oil seals. Said pressure difference is adapted to preferentially direct an oil leak from the housing through the second air-oil seal.

In accordance with a further aspect of the present invention, there is a method provided for controlling pressurized air delivered to a plurality of air-oil seals of a bearing housing in a gas turbine engine, which comprises steps of: directing an compressor bleed air flow to the bearing housing; dividing the flow into at least two flows; directing a first flow to a first air-oil seal; metering a second flow and thereby creating a step drop in pressure thereof; and directing the pressure dropped second flow to a second air-oil seal, wherein the step drop in pressure is adapted in magnitude to provide a pre-selected pressure differential between air pressures of the first and second flows provided to the first and second air-oil seals.

These and other aspects of the present invention will be better understood with reference to the following description.

DETAILED DESCRIPTION OF THE PREFERRED EMBODIMENT

Figure 1:
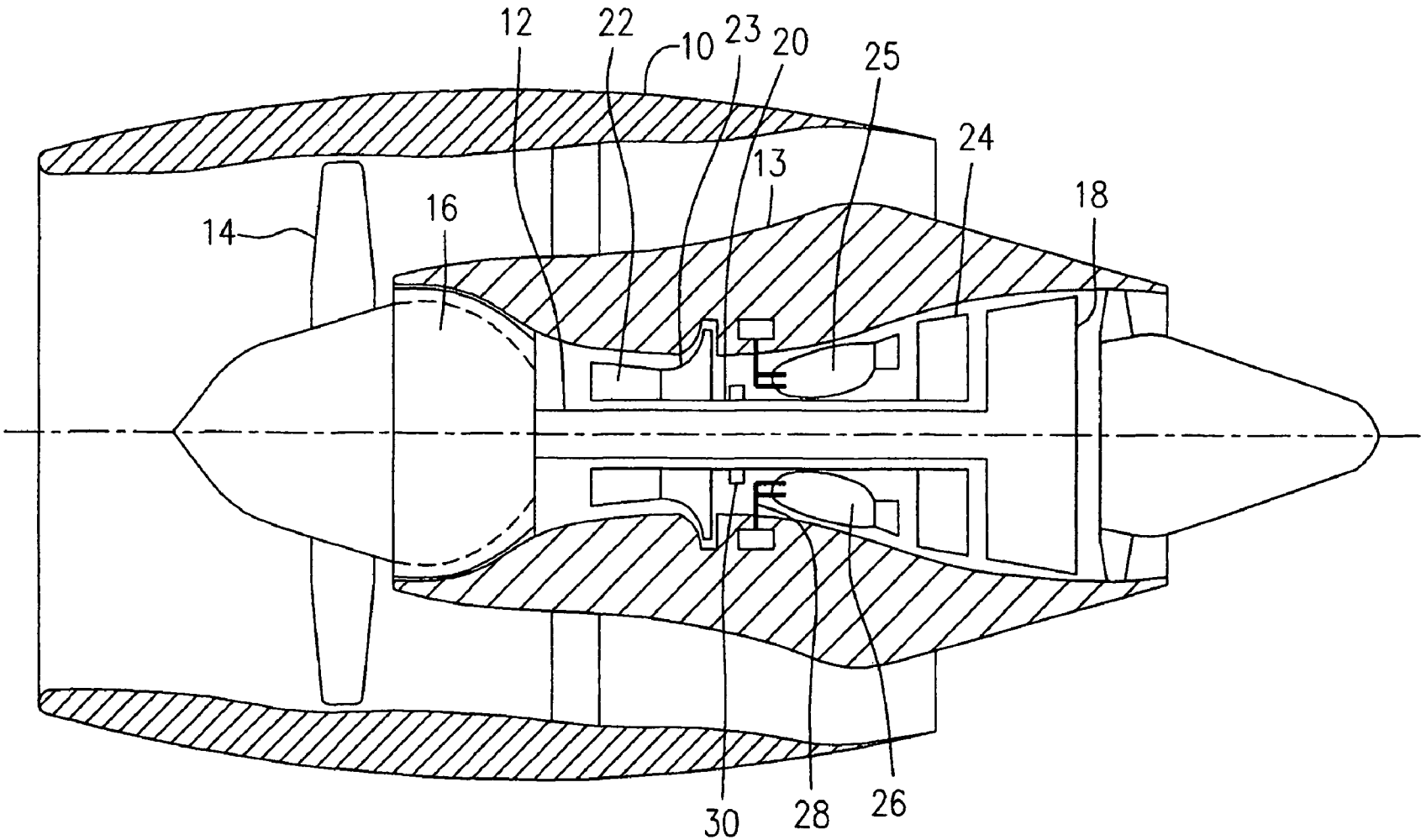
FIG. 1 is a schematic cross-sectional view of a turbofan gas turbine engine which illustrates an exemplary application of the present invention.

Referring to FIG. 1, a turbofan gas turbine engine incorporates an embodiment of the present invention, presented as an example of the application of the present invention, and includes a nacelle 10, a core casing 13, a low pressure spool assembly seen generally at 12 which includes a fan 14, low pressure compressor 16 and low pressure turbine 18, and a high pressure spool assembly seen generally at 20 which includes a high pressure compressor 22, a centrifugal compressor 23 and a high pressure turbine 24. A combustor 26 has a plurality of fuel injectors 28. Each of the low and high pressure spool assemblies 12, 20 includes a shaft (not indicated) rotatably supported by a plurality of bearing assemblies 30 (only one of which is shown). A bearing chamber pressurization system provided for supplying pressurized air to seal the bearing assembly 30 will now be described.

Figure 2:
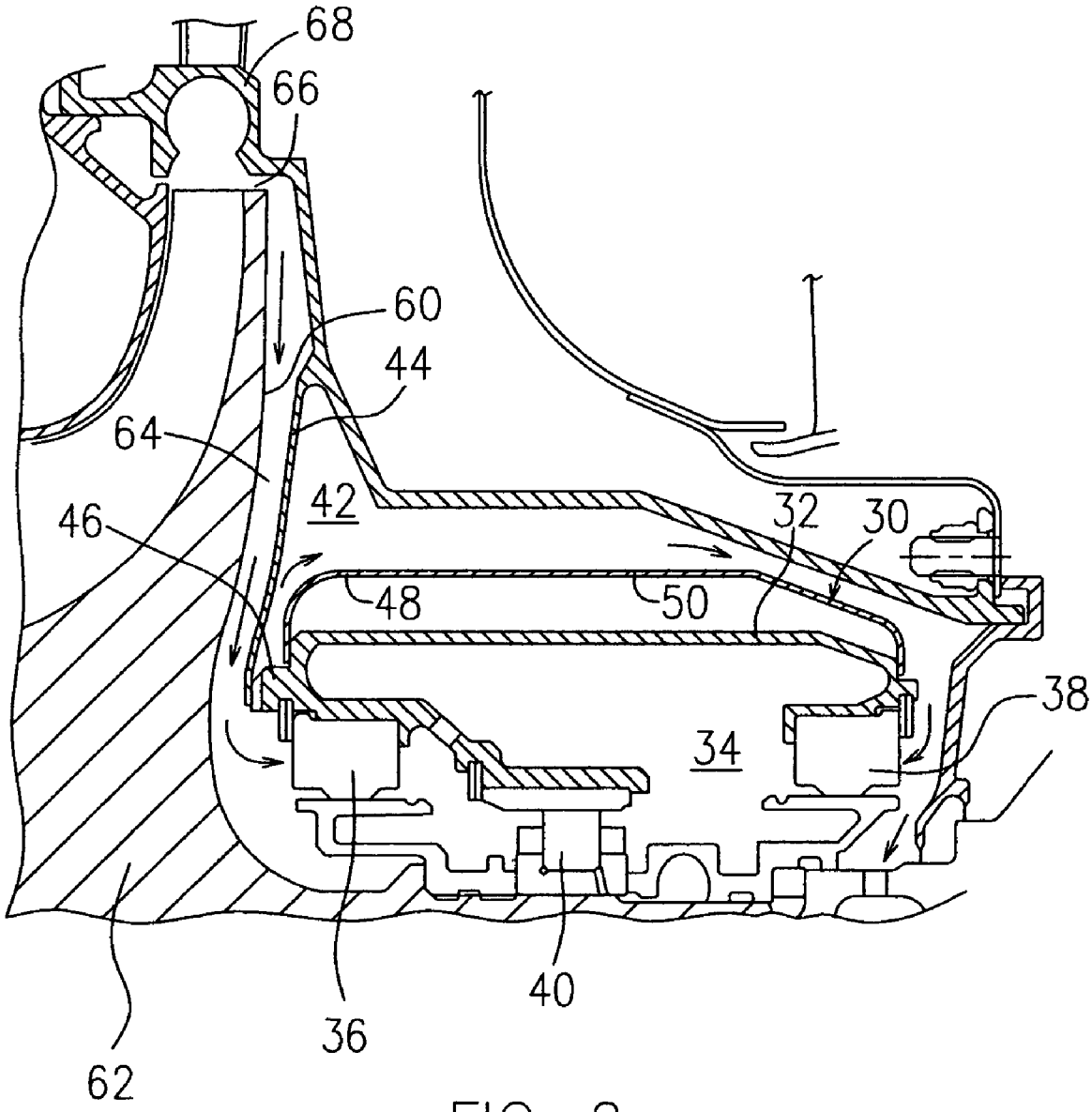
FIG. 2 is a partial cross-sectional view of the gas turbine engine of FIG. 1, illustrating a bearing chamber pressurization system according to one embodiment of the present invention.

FIG. 2 depicts the bearing chamber pressurization system according to one preferred embodiment of the present invention. The bearing assembly 30 includes an annular bearing housing 32 having a front side air-oil seal 36 and a rear air-oil side seal 38. A bearing chamber 34 is defined within the bearing housing 32 for accommodating bearings 40 which rotatably support the shaft (not indicated) of the high pressure spool. The bearing housing 32 is supported within a stationary structure (not indicated) of the engine. Annular heat shields 48, 50 are installed to cover the outer wall (not indicated) of the bearing housing 32. The heat shields 48 and 50 in combination with the outer wall of the bearing housing 32, define a space (not indicated) therebetween for insulating the bearing chamber from the combustor.

The stationary structure of the engine defines a plenum 42 surrounding the bearing assembly 30. The plenum 42 contains pressurized air which enters the bearing chamber 34 of the bearing housing 32 through the front side seal 36 and rear side seal 38.

A diffuser heat shield 44 which is preferably an annular metal plate, extends from the stationary structure of the engine radially and inwardly towards the bearing housing 32. An inner end of the annular diffuser shield 44 abuts an annular ridge 46 such that the diffuser shield 44 in combination with the ridge 46 of the bearing housing 32, forms a partition between the front and rear seals 36, 38 of the bearing housing 32.

Figure 3:
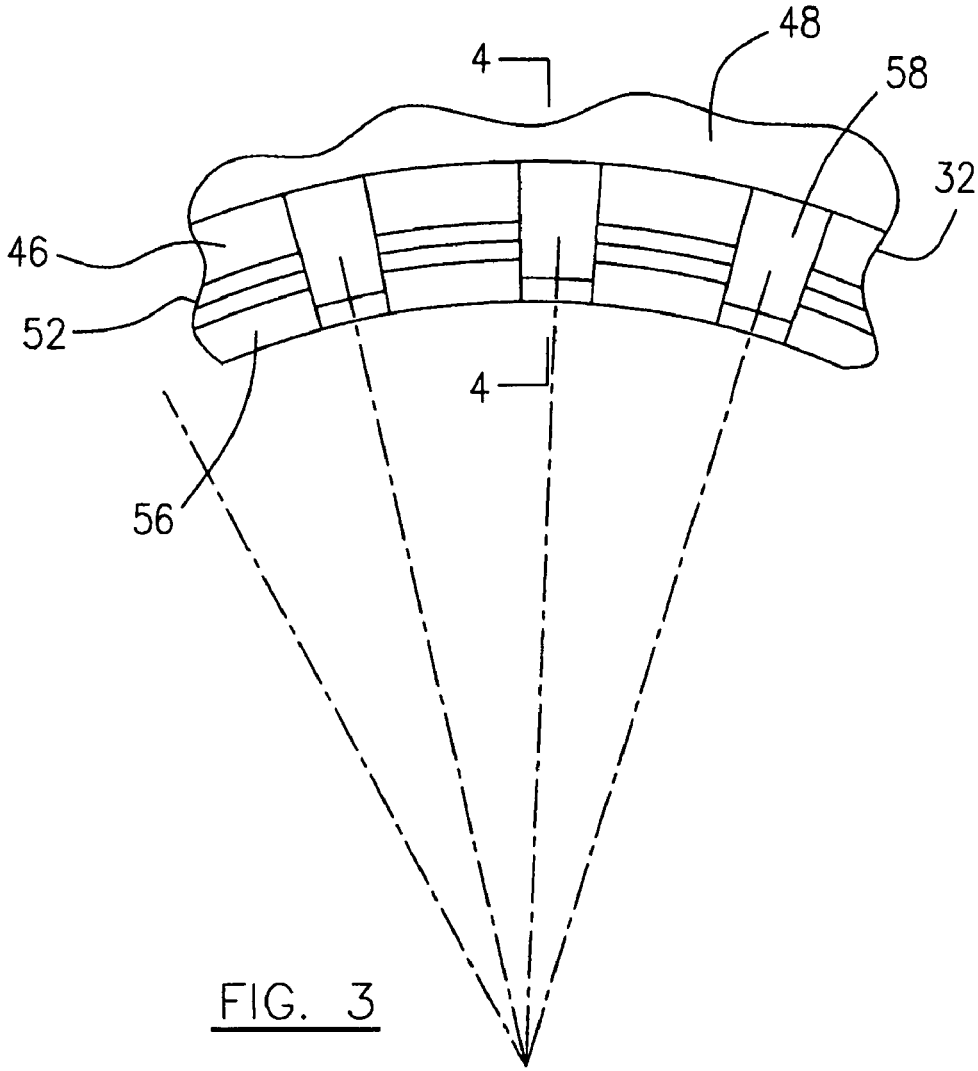
FIG. 3 is a partial front elevational view of a bearing housing of FIG. 2.
Figure 4:
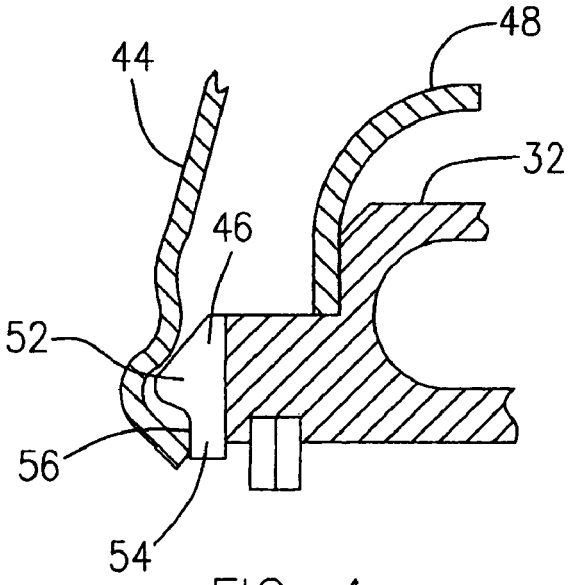
FIG. 4 is a partial cross-sectional view along line 4-4 in FIG. 3.

Referring to FIGS. 2, 3 and 4, the ridge 46 includes an axially protruding rim portion 52 preferably having bevelled surfaces (not indicated) and a recessed portion 54 having a substantially radial annular surface 56. The inner end of the diffuser shield 44 has a wave-like shape to generally correspond with the contour of the annular ridge 46 of the bearing housing 32. It is preferable to bias the diffuser shield 44 against the ridge such that the diffuser shield 44 forcibly abuts the ridge 46.

A plurality of openings, such as grooves 58, is provided in ridge 46, as shown in FIGS. 3 and 4. The grooves 58 are circumferentially spaced apart from one another and extend radially through the ridge 46, thereby forming a passage for fluid communication to the plenum 42 so that a portion of bleed air may be provided to the rear side seal 38, by-passing the front side seal 36.

The diffuser shield 44 is typically spaced apart from a back surface 60 of an impeller 62 of the centrifugal compressor 23, and thus defines a radial passage indicated by numerals 64, 66 which permits a compressor bleed air flow to be directed to the bearing housing 32. The compressor bleed air flow diverges at the inner end of the diffuser shield 44, with a portion entering the bearing chamber 34 through the front side seal 36 and a portion passing through grooves 58 to enter the plenum 42 and, ultimately, the rear side seal 38. Preferably, the flow of bleed air flow directed to the rear side seal 38 is less than the flow entering the front side seal 36, such that any leakage form the chamber 32 will tend to leak towards the turbine rather than the compressor, thereby protecting the bleed air from oil contamination.

The radial position where the compressor bleed air flow diverges to flow into the plenum 42 (i.e. towards real seal 38) is close to the radial position where the flow enters the front side seal 36. This facilitates providing a higher pressure to front side seal 36.

Furthermore, the air pressure at the respective front and rear side seals 36, 38 can be balanced (or unbalanced, as the case may be) by control of the number, size and/or shape of the orifices or openings (e.g. grooves 58) into plenum 42, which preferably creates a step drop in pressure, to vary the air flow rate and pressure supplied to the rear seal relative to the front seal. Thus, a pre-selected pressure differential between the air pressures of the respective flows to the front and rear seals can be achieved.

The grooves 58 or other openings may also be configured to deswirl the compressor bleed air flow entering the plenum 42.

The skilled reader will appreciate that changes can be made to the above embodiments without departing from the principles of the present invention taught herein. For example, neither the diffuser heat shield, nor the bearing housing need be used to provide the partition member. Any suitable type of flow/pressure dividing arrangement between the front and rear side seals of the bearing housing 32 can be used. As mentioned, grooves as such are not required, and holes, slits, etc. through the heat shield, bearing housing, casing, or other structure may be provided instead, or additionally. Though described as "front" and "rear" side seals, the present invention may be employed to provide pressure balancing between air-oil seals in any location. The principle of the present invention is applicable to other types of gas turbine engines. Still other modifications will be apparent to those skilled in the art, and thus the foregoing description is intended to be exemplary rather than limiting. The scope of the present invention is therefore intended to be limited solely by the scope of the appended claims.

We claim:

1. A bearing chamber pressurization system for a gas turbine engine, comprising:

a bearing housing defining a bearing chamber therein, the housing having first and second air-oil seals;

a source of pressurized air communicating with the air-oil seals along an air flow path;

a stationary partition disposed within the air flow path between the first and second air-oil seals of the bearing housing; and at least one metering orifice in the air flow path upstream of the first and second air-oil seals, forming a passage by-passing the first air-oil seal, the orifice being disposed in the partition and adapted to regulate relative pressures of the pressurized air provided to the first and second air-oil seals.

2. The bearing chamber pressurization system as claimed in claim 1 wherein the at least one orifice is located at a radial position, relative to a shaft of the bearing chamber, which is substantially the same as a radial position of the first air-oil seal.

3. The bearing chamber pressurization system as claimed in claim 1 wherein the metering passage comprises a plurality of radial orifices.

4. The bearing chamber pressurization system as claimed in claim 3 wherein the bearing housing includes an ridge protruding therefrom, and the orifices are provided as grooves in the ridge, the grooves being closed at an open side thereof by an adjacent structure.

5. The bearing chamber pressurization system as claimed in claim 4 wherein the adjacent structure is a centrifugal compressor heat shield, and wherein the centrifugal compressor heat shield and the ridge co-operate to provide the partition.

6. The bearing chamber pressurization system as claimed in claim 4 wherein the adjacent structure is biased against the ridge.

7. The bearing chamber pressurization system as claimed in claim 4 wherein the ridge extends circumferentially around an engine axis, and wherein the adjacent structure contacts the ridge substantially along a circumferential extent of the ridge.

8. The bearing chamber pressurization system as claimed in claim 3 wherein the orifices are shaped and configured to at least partially deswirl the air flow therethrough.

9. The bearing chamber pressurization system as claimed in claim 1 wherein the partition is provided at least partially by a centrifugal compressor heat shield.

10. The bearing chamber pressurization system as claimed in claim 1 wherein the metering passage is disposed in the bearing housing.

11. A bearing chamber pressurization system for a gas turbine engine, comprising:

a bearing housing defining a bearing chamber therein, the housing having first and second air-oil seals;

a source of pressurized air communicating with the air-oil seals along an air flow path;

means for regulating a pressure of the pressurized air, said means being provided at least partially by a centrifugal compressor heat shield of the engine and adapted to provide a pre-determined pressure difference in the pressurized air provided to the first and second air-oil seals, said pressure difference adapted to preferentially direct an oil leak from the housing through the second air-oil seal.

12. A bearing chamber pressurization system of claim 11 wherein the centrifugal compressor heat shield co-operates with the bearing housing to provide said means.

13. A method of controlling pressurized air delivered to a plurality of air-oil seals of a bearing housing in a gas turbine engine, the method comprising:

directing an compressor bleed air flow to the bearing housing;

dividing the flow into at least two flows by a stationary configuration;

directing a first flow to a first air-oil seal;

metering a second flow and thereby creating a step drop in pressure thereof; and directing the pressure dropped second flow to a second air-oil seal, wherein the step drop in pressure is adapted in magnitude to provide a pre-selected pressure differential between air pressures of the first and second flows provided to the first and second air-oil seals.

14. The method as claimed in claim 13 wherein the flows are divided at a radial location relative to an associated shaft which is substantially the same as a radial position of the first air-oil seal.

15. The method as claimed in claim 13 wherein a centrifugal compressor heat shield is used at least partially to meter the second flow.

16. The method as claimed in claim 15 wherein the step of metering is achieved using grooves, one side of which is closed by the heat shield.

* * * * *